US009101236B1

(12) United States Patent
Vayntraub

(10) Patent No.: US 9,101,236 B1
(45) Date of Patent: Aug. 11, 2015

(54) ARTICLE POSITIONING DEVICE

(71) Applicant: Vladimir Vayntraub, Fallbrook, CA (US)

(72) Inventor: Vladimir Vayntraub, Fallbrook, CA (US)

( * ) Notice: Subject to any disclaimer, the term of this patent is extended or adjusted under 35 U.S.C. 154(b) by 0 days.

(21) Appl. No.: 14/252,769

(22) Filed: Apr. 14, 2014

Related U.S. Application Data

(63) Continuation-in-part of application No. 12/827,961, filed on Jun. 30, 2010, now abandoned.

(51) Int. Cl.

| | |
|---|---|
| ***A47G 1/16*** | (2006.01) |
| ***A47G 1/24*** | (2006.01) |
| ***A47G 1/17*** | (2006.01) |
| *A47G 1/20* | (2006.01) |

(52) U.S. Cl.
CPC ..... *A47G 1/164* (2013.01); *A47G 1/1606* (2013.01); *A47G 1/168* (2013.01); *A47G 1/205* (2013.01)

(58) Field of Classification Search
CPC ..... A47G 1/168; A47G 1/1606; A47G 1/205
USPC ..... 248/467, 475.1, 477, 488, 489, 496, 248/478
See application file for complete search history.

(56) References Cited

U.S. PATENT DOCUMENTS

| | | | | | |
|---|---|---|---|---|---|
| 3,529,799 | A | * | 9/1970 | Schaefer | 248/496 |
| 3,622,116 | A | * | 11/1971 | Fellows | 248/467 |
| 3,848,843 | A | * | 11/1974 | Levy | 248/224.51 |
| 3,861,639 | A | * | 1/1975 | Morrill | 248/489 |
| 5,425,524 | A | * | 6/1995 | Messina, Jr. | 248/475.1 |
| 5,433,416 | A | * | 7/1995 | Johnson | 248/475.1 |
| 5,605,313 | A | * | 2/1997 | Erickson et al. | 248/467 |

* cited by examiner

*Primary Examiner* — Tan Le
(74) *Attorney, Agent, or Firm* — QuickPatents; Kevin Prince

(57) ABSTRACT

A system is disclosed for maintaining an article, such as a picture frame suspended by a saw-tooth bracket, in a desired position on a vertical surface, such as a wall having a nail. The system comprises a first bracket having a projecting nub, and a second bracket having a cooperative corresponding divot. With the first bracket fixed to a rear surface of the article and the second bracket fixed to the wall, such that when the article is in the desired position the nub of the first bracket is engaged with the divot of the second bracket, if jarred, the article pivots back and forth about the nail until the nub becomes re-engaged with its cooperative divot, thereby bringing the article back into the desired position. Each bracket may be temporarily mutually affixed at interlocking ribs to facilitate initial adhesion with the article and the vertical surface.

14 Claims, 4 Drawing Sheets

ARTICLE POSITIONING DEVICE

CROSS-REFERENCE TO RELATED APPLICATIONS

This application is a continuation-in-part of U.S. patent application Ser. No. 12/827,961, filed on Jun. 30, 2010, and incorporated herein by reference.

STATEMENT REGARDING FEDERALLY SPONSORED RESEARCH AND DEVELOPMENT

Not Applicable.

FIELD OF THE INVENTION

This invention relates to picture hanging, and more particularly to a system for hanging an article such as a picture frame on a vertical surface and maintaining same in a desired position.

DISCUSSION OF RELATED ART

A nail or screw is typically used to hang a picture frame or other article on a wall surface, the nail after being pounded into the wall projecting enough to allow a clasp on the picture frame to secure thereto. The main drawback of such a method is that the clasp on the picture frame may not be precisely centered on the picture frame, wherein gravity over time causes the picture to tilt away from level until the center of gravity aligns with the nail. To overcome this drawback, the conventional "sawtooth" type of clasp has been widely used, such a claps providing a plurality of pivot points about the nail such that one such pivot point may be selected that is closest to the vertical center of gravity of the picture frame. However, such a device still suffers from the drawback that if the picture frame is jarred it may not return to level due to friction of the picture frame against the wall. That is, gravity may not act sufficiently on the picture frame to overcome the friction of the lower edge of the picture frame against the wall to cause the picture frame to return to a level orientation. The object hangers taught in U.S. Pat. No. 5,605,313 to Erickson et al. on Feb. 25, 1997, and U.S. Pat. No. 4,611,780 to Robertson on Sep. 16, 1986, suffer from the same drawbacks.

The prior art is replete with devices for overcoming this drawback. For example, US Patent Application 2008/0078915 to Haje on Apr. 3, 2008, teaches a two-piece hanger device that serves to prevent the picture frame from moving once its level orientation is established. However, such a device merely transfers the force of a jarring impact from the picture frame to the hanger device, possibly damaging the picture frame, the hanger device, the wall surface to which it is attached, or all three. Such a device, when in use, results in two relatively proximate contact points between each piece of the hanger device. Depending on the height of the picture frame, a significant moment arm results about the top contact point with such a device, and it is the lower part of the picture frame that tends to be inadvertently jarred by passersby. Thus such a device is not reliable and can lead to damage of the picture frame and wall surfaces to which it is mounted.

The positioning and locking hanging system taught in U.S. Pat. No. 6,578,812 to Lemire on Jun. 17, 2003, suffers from many of the same drawbacks. Further, such a device has numerous parts and is therefore expensive to manufacture and relatively complicated to use.

In my previous U.S. patent application Ser. No. 12/710,931, filed on Feb. 23, 2010, I taught an article hanging device that overcomes many of the aforementioned drawbacks. However, in cases where the user of such a device does not desire to change an existing pivoting bracket that already exists on the back of the picture frame, for example, the advantages of the hanging system of my previous application cannot be realized.

In my previous U.S. patent application Ser. No. 12/827,961, filed on Jun. 30, 2010, I taught an improved article hanging device that allows for use on existing frame suspended from a wall with a nail, screw or other pivot-allowing support. However, my improved device proved somewhat difficult to install on the wall and on existing frames in a way that would guarantee mutual alignment of two of the brackets.

Therefore, there is a need for a hanging system that, when the picture frame is jarred, allows the picture frame to return to its original desired orientation reliably. Such a needed system would be relatively inexpensive to manufacture, and easy to install and use. Such a needed system would not be able to damage either the picture frame or the wall in the event of a particularly strong jarring of the picture frame. Further, such a needed device would allow an existing pivoting hanging device to be used, thereby not requiring its removal from the picture frame, and would be easily installed thereon. The present invention accomplishes these objectives.

SUMMARY OF THE INVENTION

The present device is a system for maintaining an article, such as a picture frame, in a desired position on a vertical surface, such as a wall. Typically the desired position is with the article level, for example. Such an article includes at least a rear surface, a top edge, and a bottom edge, and an article attachment device, such as a sawtooth bracket, or the like, fixed to the rear surface of the article proximate its top edge. Such article attachment devices are known in the art and typically allow the article to pivot about a wall attachment post, such as a screw, nail, or the like, while on the vertical surface.

The system comprises a first bracket and a second bracket. The first bracket has at least one projecting nub, and the second bracket has at least one divot, each of which is cooperative with one of the at least one projecting nubs of the first bracket. Preferably each divot and/or cooperating nub has a gradual and continuous curvature so as to provide a smooth approach as the nub engages the divot.

In use, the first bracket may be fixed to the rear surface of the article and the second bracket may be fixed to the vertical surface, such that when the article is in the desired position with the article attachment device of the article engaged with the wall attachment post, each nub of the first bracket is engaged with the cooperative divot of the second bracket. If jarred, the article pivots back and forth on the wall attachment post until each nub becomes re-engaged with its cooperative divot to bring the article back into the desired position.

Further, the second bracket may include at least one depression on a rear side thereof for receiving a piece of two-sided foam tape for adhering the second bracket to either the vertical surface or the rear surface of the article, such that when so mounted a gap formed between the rear surface of the second bracket and the surface to which the second bracket is mounted is minimized. The foam tape may also be used to mount the first bracket to the other surface. The side edges of each second bracket may also be tapered the nub will be more inclined to come to rest at the divot, the article being in the desired position.

The present invention is a hanging system that, when the picture frame is jarred, allows the picture frame to return to its level orientation reliably. The present system is relatively inexpensive to manufacture, and easy to install and use. The present invention does not result in damage to either the picture frame or the wall in the event of a particularly strong jarring of the picture frame, and in fact the present invention helps protect against damage to the wall and the picture frame by acting as an intermediary bumper. Further, the present invention allows an existing pivoting hanging device to be used, thereby not requiring its removal from the picture frame. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list. Any use of the word "means" herein is intended to invoke means-plus-function limitation in accordance with 35 U.S.C. §112, sixth paragraph, even if the word "means" follows words describing the function.

Figure 1:
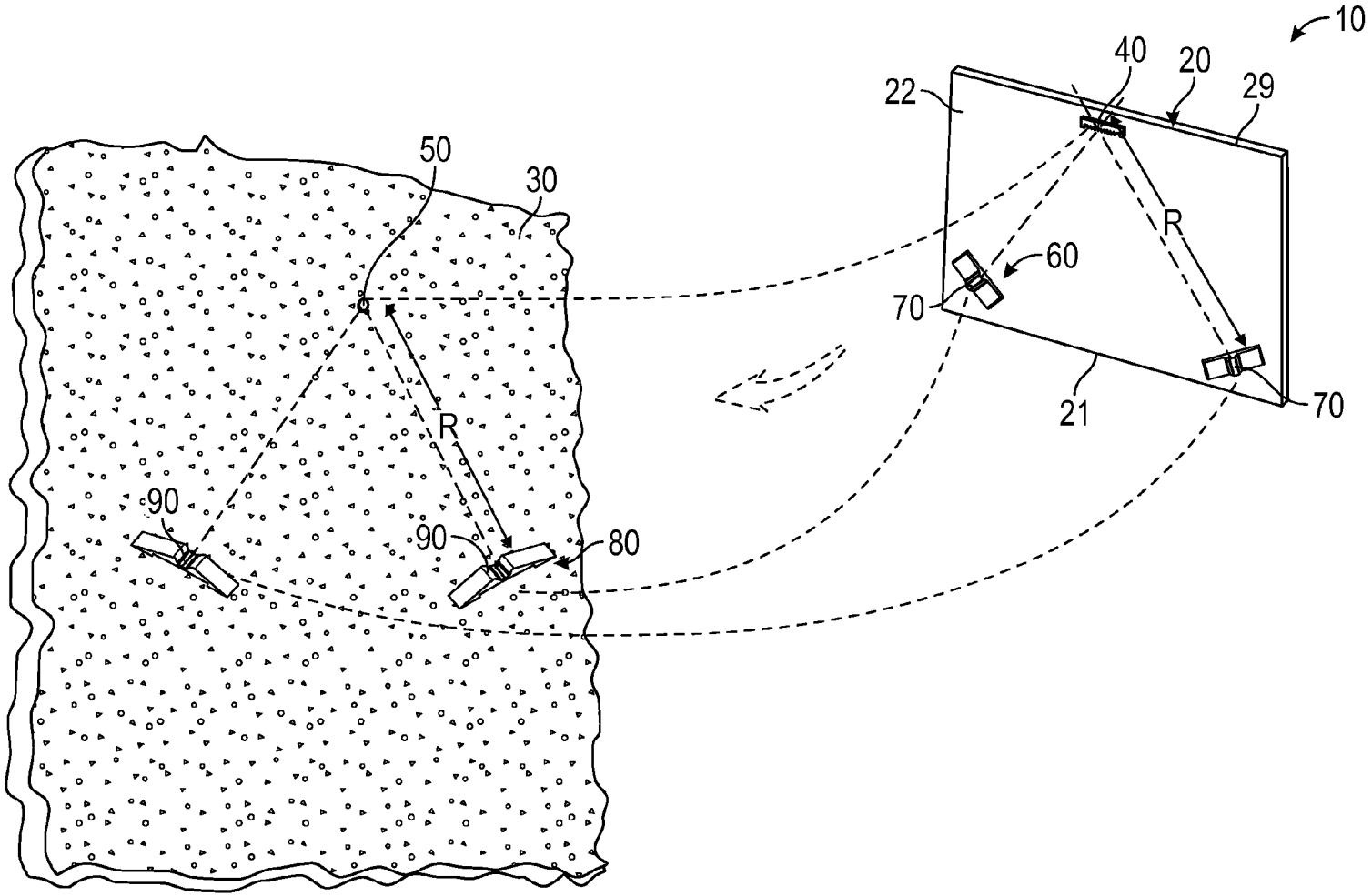
FIG. 1 is an exploded perspective view of a system for maintaining an article in a desired position on a vertical surface.
Figure 2:
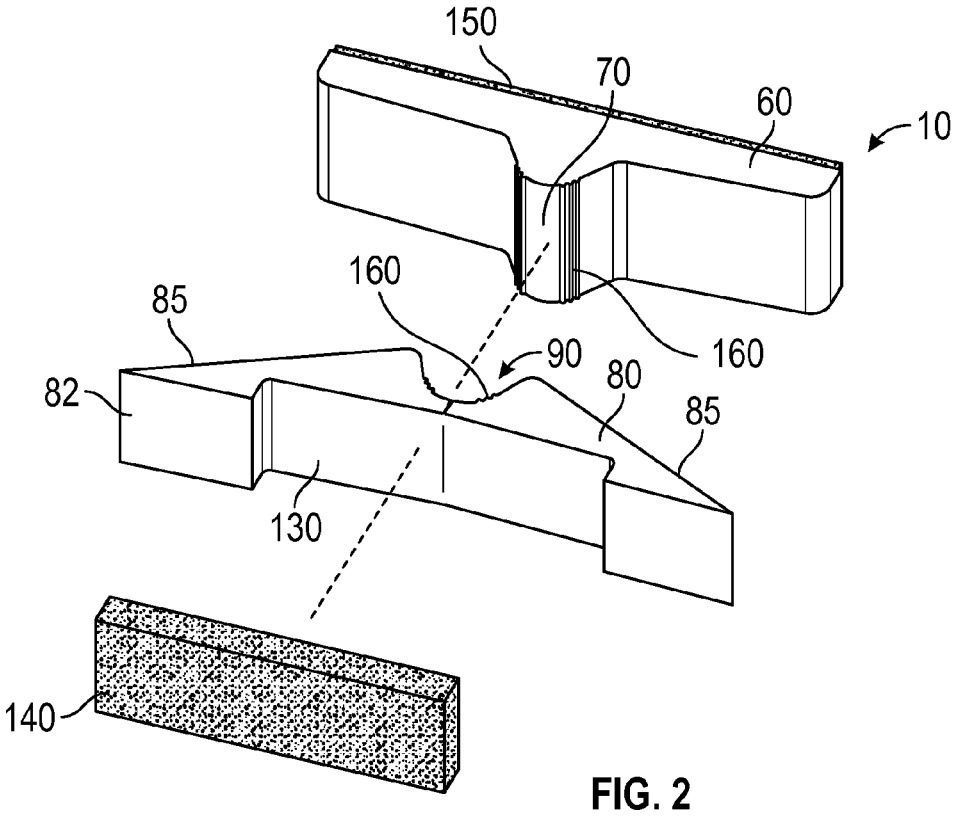
FIG. 2 is an exploded perspective view thereof.

FIGS. 1 and 2 illustrate a system 10 for maintaining an article 20, such as a picture frame, in a desired position on a vertical surface 30, such as a wall. Typically the desired position is with the article 20 level, for example. Such an article 20 includes at least a rear surface 22, a top edge 29, and a bottom edge 21, and an article attachment device 40, such as a conventional saw-tooth bracket as illustrated, or the like, fixed to the rear surface 22 of the article 20 proximate its top edge 29. Such article attachment devices 40 are known in the art and typically allow the article 20 to pivot about a wall attachment post 50, such as a screw, nail, or the like, while on the vertical surface 30.

Figure 3:
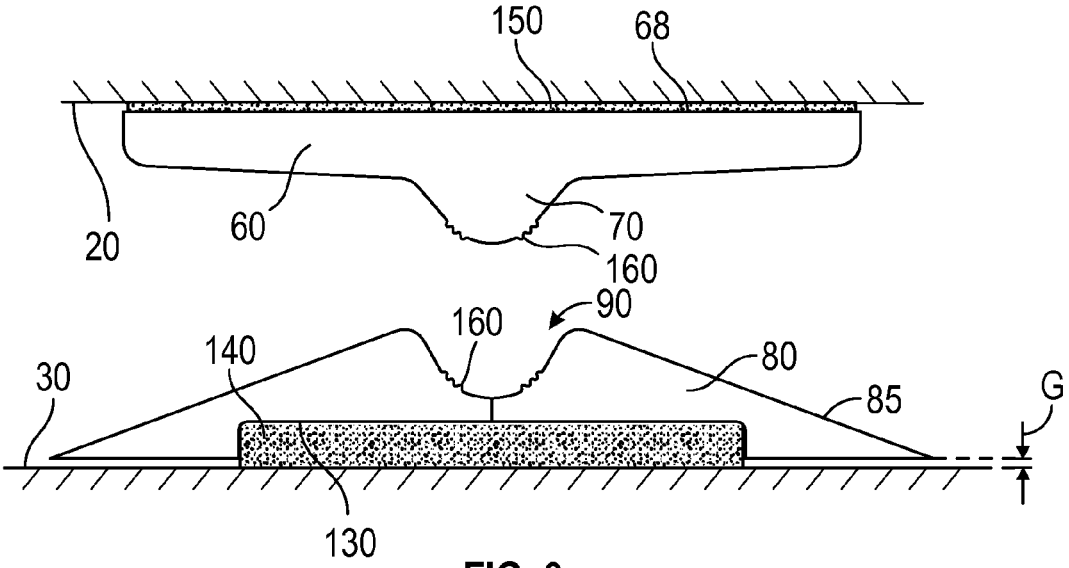
FIG. 3 is a top plan view thereof.

The system 10 comprises a first bracket 60 and a second bracket 80. The first bracket 60 has at least one projecting nub 70 (FIGS. 2 and 3), and is preferably stamped out of a sheet metal or plastic material, made by a plastic injection molding or extrusion method, or the like.

Figure 6:
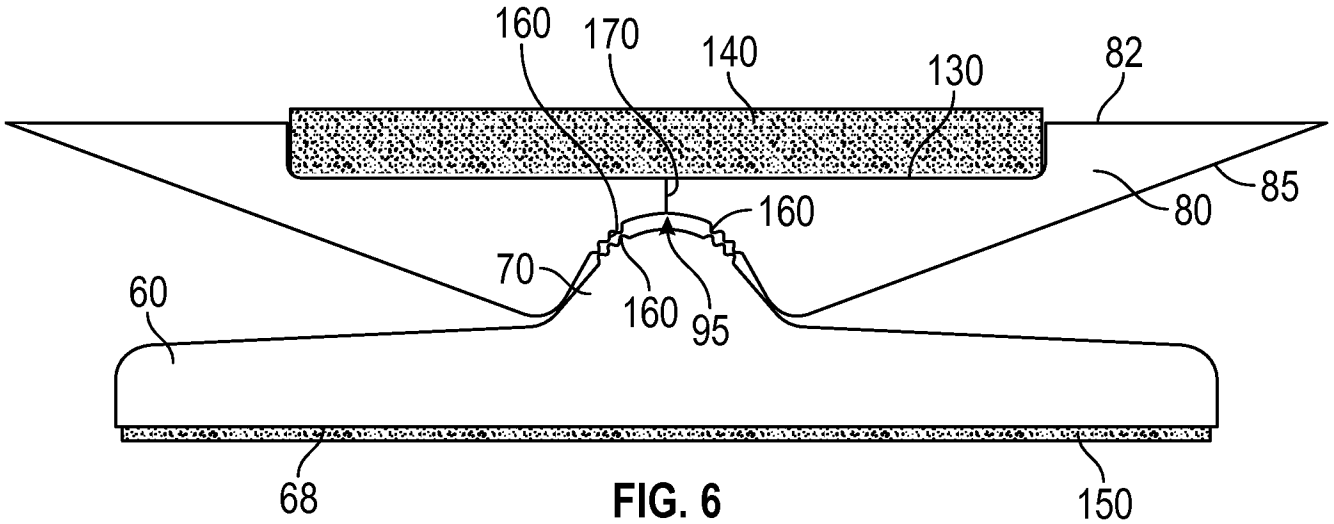
FIG. 6 is a top plan view of the invention when the first and second brackets are engaged but not at the interlocking ribs.

The second bracket 80 has at least one divot 90, each of which is cooperative with one of the at least one projecting nubs 70 of the first bracket 60. The second bracket 80 is likewise formed from a sheet metal or plastic stamping process, made by plastic injection molding or extrusion, or the like. The brackets 60,80 are each preferably rigid or at least semi-rigid. Preferably the first bracket 60 has exactly one nub 70, and the second bracket 80 has exactly one divot 90, as illustrated. Further, either the divot 90, the cooperating nub 70, or both have a gradual and continuous curvature so as to provide a smooth approach as the nub 70 engages the divot 90 laterally (FIG. 6). In one embodiment, each divot 90 takes the form of an aperture (not shown).

In use, the first bracket 60 may be fixed to the rear surface 22 of the article 20 with a first length 150 of two-sided foam tape, and the second bracket 80 may be fixed to the vertical surface 30 with a second length 140 of the two-sided foam tape (FIG. 3), such that when the article 20 is in the desired position with the article attachment device 40 of the article 20 engaged with the wall attachment post 50, each nub 70 of the first bracket 60 is engaged with the cooperative divot 90 of the second bracket 80 (FIG. 6). When mounting each bracket 60,80, it is important that first bracket 60 is fixed a distance R (FIG. 1) away from the article attachment device 40, and that the second bracket 80 is fixed the same distance R away from the wall attachment post 50 (FIG. 1), and that each bracket 60,80 is cooperatively aligned tangentially to the circle formed by R about the wall attachment post 50.

Figure 4:
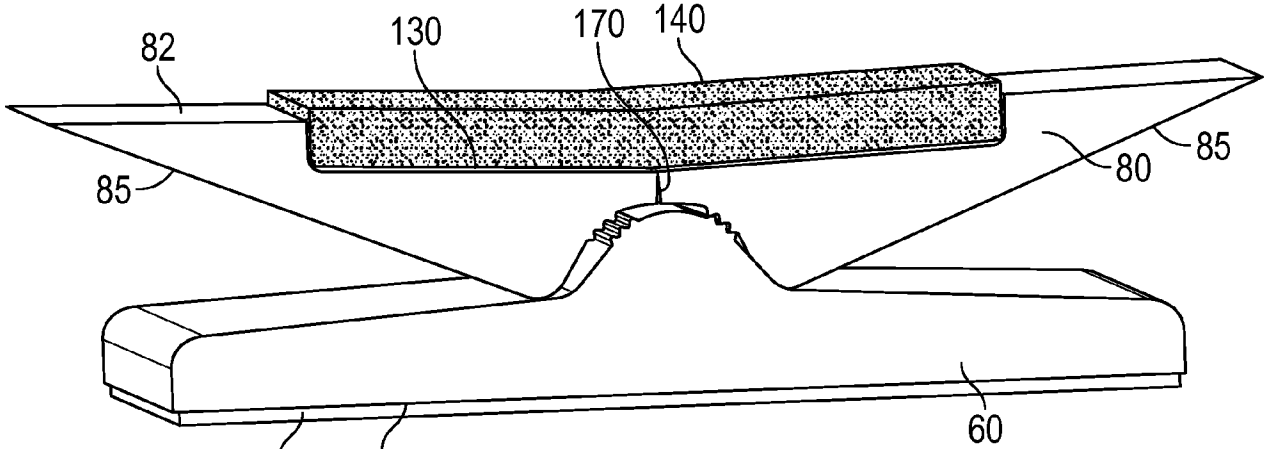
FIG. 4 is a perspective view of the invention, illustrated with a first and second bracket engaged at interlocking ribs thereof.
Figure 5:
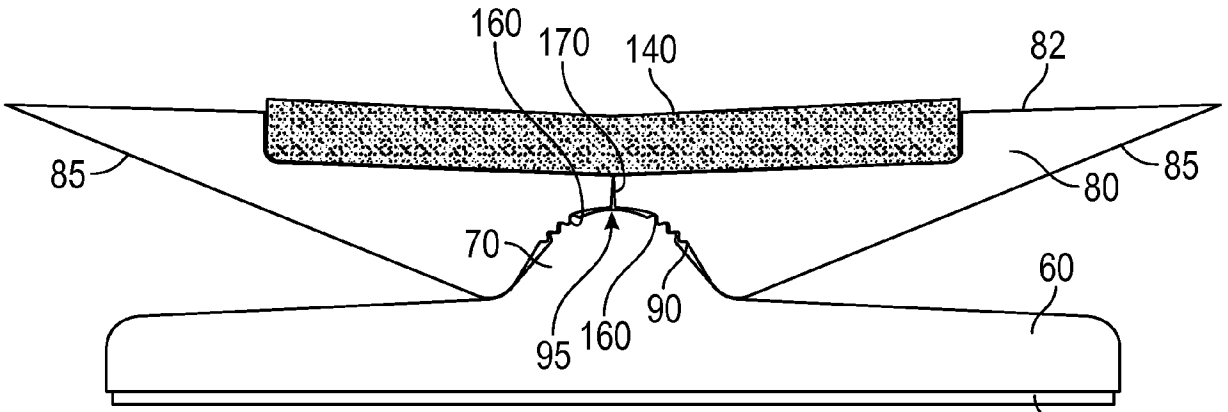
FIG. 5 is a top plan view of FIG. 4.

To this end the brackets 60,80 may be temporarily fixed by flexing the second bracket 80, preferably at the slit 170 partially through a center portion 95 of the divot 90, and mutually engaging the interlocking ribs 160 of each bracket 60,80 (FIGS. 4 and 5). As such, both brackets 60,80 together may be fixed to the rear side 22 of the article 20 at a point proximate the bottom side 29 of the article 20, and then the article 20 pressed against the vertical surface 30 at the desired location. Further pressure against the article 20 towards the vertical surface 30 causes the first bracket 60 to press against the second bracket 80 until the second bracket 80 is straightened and fully adhered to the vertical surface 30, resulting in the mutual release of the interlocking ribs 160. During subsequent use, the ribs 160 are prevented from re-engaging once the second bracket 80 is straightened (FIG. 6).

While the preceding discussion and the illustrations show the first bracket 60 fixed with the article 20, and the second bracket 80 fixed with the vertical surface 30, it should be understood that herein, alternately, the first bracket 60 may just as easily be fixed to the vertical surface 30 and the second bracket 80 fixed to the rear surface 22 of the article 20.

If jarred, the article 20 pivots back and forth on the wall attachment post 50 until each nub 70 becomes re-engaged with its cooperative divot 90 to bring the article 20 back into the desired position. The terms "engaged" or "fully engaged" refer to the occurrence of one of the nubs 70 being as fully engaged as possible with one of the divots 90 as in FIG. 6, each nub 70 preferably being substantially the same size as each cooperative divot 90 so that there is only one unique desired rotational position of the article 20 on the vertical surface 30.

The second bracket 80 may include at least one depression 130 on a rear side 82 thereof for receiving a length 140 of the two-sided foam tape (FIGS. 2-6), the foam tape 140 for adhering the second bracket to either the vertical surface 30 or the rear surface 22 of the article 20, such that when so mounted a gap G (FIG. 3) formed between the rear surface 82 of the second bracket 80 and the surface 22,30 to which the second bracket 80 is mounted is minimized. As such, the chance of the nub 70 coming to rest at a side edge 85 of the second bracket 80 instead of at the divot 90 of the second bracket 80 is reduced.

The foam tape may also be used to mount the first bracket 60 to the other surface 22,30, such a length 150 of foam tape being, for example, that made by 3M under the brand Command Adhesive, or conventional two-sided foam tape, or the like.

Further, the side edges 85 of each second bracket 80 may be tapered in order to reduce the change in slope between the surface 22,30 to which the second bracket 80 is mounted and the side edges 85 of the second bracket 80. Further, the change in slope adjacent each divot 90 may be formed to be relatively sudden, so that the nub 70 will be more inclined to come to rest at the divot 90, the article 20 being in the desired position. Still further, the length of each second bracket 80 is long enough to ensure that when the nub 70 fixed to the article 20 contacts the side edge 85 thereof, the weight of the article 20 will still be shifted significantly to one side of the wall attachment post 50. As such, the weight of the article 20 will force the nub 70 over the side edge 85 of the second bracket until the nub 70 comes to rest engaged with the divot 90, the weight of the article 20 being generally balanced about the wall attachment post 50 at such a point (the desired position).

As illustrated in FIG. 1, two of the systems 10 may be used for each article 20. However, any number of systems 10 may be used.

While a particular form of the invention has been illustrated and described, it will be apparent that various modifications can be made without departing from the spirit and scope of the invention. For example, the shape of each bracket 60,80 may vary from the rectangular shown in the figures. For example, round brackets 60,80 may be utilized. Accordingly, it is not intended that the invention be limited, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention under the claims.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. A system for maintaining an article in a desired position on a vertical surface, the article including at least a rear surface, a top edge, a bottom edge, and an article attachment device fixed to the rear surface of the article proximate its top edge such that the article may pivot about a wall attachment post fixed to the vertical surface, the system comprising:

a first bracket having at least one curved, convex projecting nub having at least two interlocking ribs each on opposing sides of the nub and mutually separated by a curved vertex of the nub, each interlocking rib extending the length of the nub, and a first length of two-sided foam tape fixed to a rear side of the first bracket for adhering the first bracket to the rear surface of the article; and a second bracket having at least one curved, concave divot having at least two interlocking ribs each on opposing sides of the divot and mutually separated by a curved vertex of the divot, each interlocking rib extending the length of the divot and cooperative with the interlocking ribs of one of the at least one projecting nubs of the first bracket, the second bracket including two tapered side edges and at least one depression on a rear side of the second bracket for receiving a second length of the two-sided foam tape for adhering the second bracket to the vertical surface;

the second bracket able to be flexed to open the at least one divot wide enough so that the interlocking ribs of the first and second brackets may be mutually engaged to temporarily affix the first and second brackets together with a resilient clamping force of the second bracket, the first bracket when pressing against the second bracket causing the second bracket to straighten to cause mutual release of each of the interlocking ribs, each nub of the first bracket when engaged with the cooperative divot of the second bracket when the article is in the desired position on the vertical surface and when the first bracket is adhered to the rear surface of the article proximate the bottom edge thereof and when the second bracket is adhered to the vertical surface, if jarred the article pivots back and forth on the wall attachment post until each nub becomes re-engaged with its cooperative divot to bring the article back into the desired position.

2. The system of claim 1 wherein the first bracket includes exactly one nub and the second bracket includes exactly one cooperative divot.

3. The system of claim 1 wherein each bracket is formed by metal stamping from a sheet metal material.

4. The system of claim 1 wherein each bracket is formed from a plastic sheet material.

5. The system of claim 1 wherein each bracket is formed from a plastic material through an injection molding process.

6. The system of claim 1 wherein each bracket is formed from a plastic extrusion process.

7. The system of claim 2 wherein the second bracket includes a slit partially through a center portion of the divot, whereby the second bracket may be flexed to allow mutual engagement of the interlocking ribs of the first and second brackets.

8. A system for maintaining an article in a desired position on a vertical surface, the article including at least a rear surface, a top edge, a bottom edge, and an article attachment device fixed to the rear surface of the article proximate its top edge such that the article may pivot about a wall attachment post fixed to the vertical surface, the system comprising:

a first bracket having at least one projecting nub having at least two interlocking ribs each on opposing sides of the nub and each extending the length of the nub, and a first length of two-sided foam tape fixed to a rear side of the first bracket for adhering the first bracket to the vertical surface; and a second bracket having at least one divot having at least two interlocking ribs each on opposing sides of the divot and each extending the length of the divot and cooperative with the interlocking ribs of one of the at least one projecting nubs of the first bracket, the second bracket including two tapered side edges and at least one depression on a rear side of the second bracket for receiving a second length of the two-sided foam tape for adhering the second bracket to the rear surface of the article;

the second bracket able to be flexed to open the at least one divot wide enough so that the interlocking ribs of the first and second brackets may be mutually engaged to temporarily affix the first and second brackets together with a resilient clamping force of the second bracket, the first bracket when pressing against the second bracket causing the second bracket to straighten to cause mutual release of each of the interlocking ribs, each nub of the first bracket when engaged with the cooperative divot of the second bracket when the article is in the desired position on the vertical surface, if jarred the article pivots back and forth on the wall attachment post until each nub becomes re-engaged with its cooperative divot to bring the article back into the desired position.

9. The system of claim 8 wherein the first bracket includes exactly one nub and the second bracket includes exactly one cooperative divot.

10. The system of claim 8 wherein each bracket is formed by metal stamping from a sheet metal material.

11. The system of claim 8 wherein each bracket is formed from a plastic sheet material.

12. The system of claim 8 wherein each bracket is formed from a plastic material through an injection molding process.

13. The system of claim 8 wherein each bracket and is formed from a plastic extrusion process.

14. The system of claim 9 wherein the second bracket includes a slit partially through a center portion of the divot, whereby the second bracket may be flexed to allow mutual engagement of the interlocking ribs of the first and second brackets.

* * * * *